United States Patent [19]

Williamson

[11] 4,398,629

[45] Aug. 16, 1983

[54] PLATE LATCH AND GUIDE SYSTEM

[75] Inventor: Calvin C. Williamson, Napa, Calif.

[73] Assignee: Kaiser Steel Corporation, Oakland, Calif.

[21] Appl. No.: 416,260

[22] Filed: Sep. 9, 1982

Related U.S. Application Data

[63] Continuation of Ser. No. 198,766, Oct. 20, 1980, abandoned.

[51] Int. Cl.[3] ..... B65G 37/00; B65G 49/00

[52] U.S. Cl. ..... 198/479; 72/311; 198/486; 198/621; 198/627; 198/721; 198/726; 198/748

[58] Field of Search ..... 198/479, 486, 653, 694, 198/695, 623, 626, 627, 628, 621, 721, 726, 748; 414/77; 144/245 R, 245 B; 271/268; 83/409, 206; 72/311, 422

[56] References Cited

U.S. PATENT DOCUMENTS 3,108,682 10/1963 Zipper ..... 198/653 X 4,015,702 4/1977 Bergling ..... 198/486

*Primary Examiner*—Jeffrey V. Nase

*Attorney, Agent, or Firm*—James E. Toomey

[57] ABSTRACT

Latch and guide system for gripping steel plate and the like while it is edge-formed. A pulley system is driven to apply tension to cables which actuate gripping clamps. The clamps travel within channel guides along the length of the system and restrain the plate from lateral movement.

11 Claims, 17 Drawing Figures

50
52
C5
C6
R3
R4
B2
A2
C7
C8
10'
B1
A1
7
16
21
17
F2
F3
l2
l1

PLATE LATCH AND GUIDE SYSTEM

This application is a continuation of application Ser. No. 06/198,766, filed Oct. 20, 1980, now abandoned.

BACKGROUND OF THE INVENTION

1. Field of the Invention

This invention relates to a system and apparatus for restraining lateral movement of metal plates and sheet and the like while they are being conveyed longitudinally through various stations as their edges are worked upon. Examples of such operations are edge trimming and forming of plates prior to shaping into large diameter pipe, or in welding reenforcing elements thereon, or performing other fabricating operations wherein skewing or misalignment of the plate may occur and would be undesirable and detrimental to subsequent operations.

2. Description of Prior Art

It is well known to use clamping or gripping means on the trailing edges of metal sheet and plate to restrain lateral movement of a flat section as it is passed through a metal working operation. In such arrangements the gripping elements may be positioned within channels or other guiding arrangements to permit forward and reverse movement of the clamps and plates, and at the same time to prevent lateral movement thereof. These systems have not always been satisfactory because of the difficulty of maintaining adequate gripping pressure while the plate section moves forward and maintaining it in the proper position, or otherwise controlling the plates and clamps, while they are subjected to the tensions and side forces present during fabrication of the plate or any other working operation. Further, the various types of apparatus presently in use are expensive and complicated to operate.

U.S. Pat. No. 4,015,702 is to a method and apparatus for successively conveying large metal plates of varying sizes to a particular position where a welding operation of the like may be performed. It utilizes a guide beam in which gripping elements are used on the forward and rear edges of each plate section. However, the gripping elements are intended to be fastened to channel beam guides and the channel beams travel through the work area. Moreover, the channel beams are moved by a rack and pinion arrangement which is cumbersome and far too slow to be practical for an operation involving edge forming and trimming of a plate for use in making large diameter pipe.

U.S. Pat. No. 4,090,703 discloses apparatus for feeding rectangular metal sheets to a cupping press in which can body blanks are cut and drawn from the metal sheets. Several sheets feeding mechanisms are provided along a conveyor table. Endless chains and feedfinger arrangements move the metal sheets. The trailing edge of the sheet is engaged by a reciprocating feedfinger arrangement to advance and accurately position a sheet section from which blanks are to be stamped. The scrap is discharged froom the press or table on which the stamping takes place. A plurality of longitudinally extending laterally narrow strips are provided to support the sheet sections which are to be blanked. There are also three separate feed units. The metal sections are not subjected to the lateral forces and torque comparable to roll forming or other fabricating operations which would cause misalignment and skewing during passage through the machine.

U.S. Pat. No. 1,986,857 discloses a complicated machine for folding corrugated paper blanks during their passage across an operating table. Although chain and pulley arrangements are disclosed, the nature of the materials which are being worked upon, that is, corrugated paper, and the problems involved are different than those encountered by applicant. The equipment employed in the patent is primarily a feeding device and would not be useful for handling steel plate.

Accordingly, the art does not suggest a simple, low cost and efficient arrangement such as the present invention.

DETAILED DESCRIPTION OF THE INVENTION

Figures 1, 2, 3, 4:
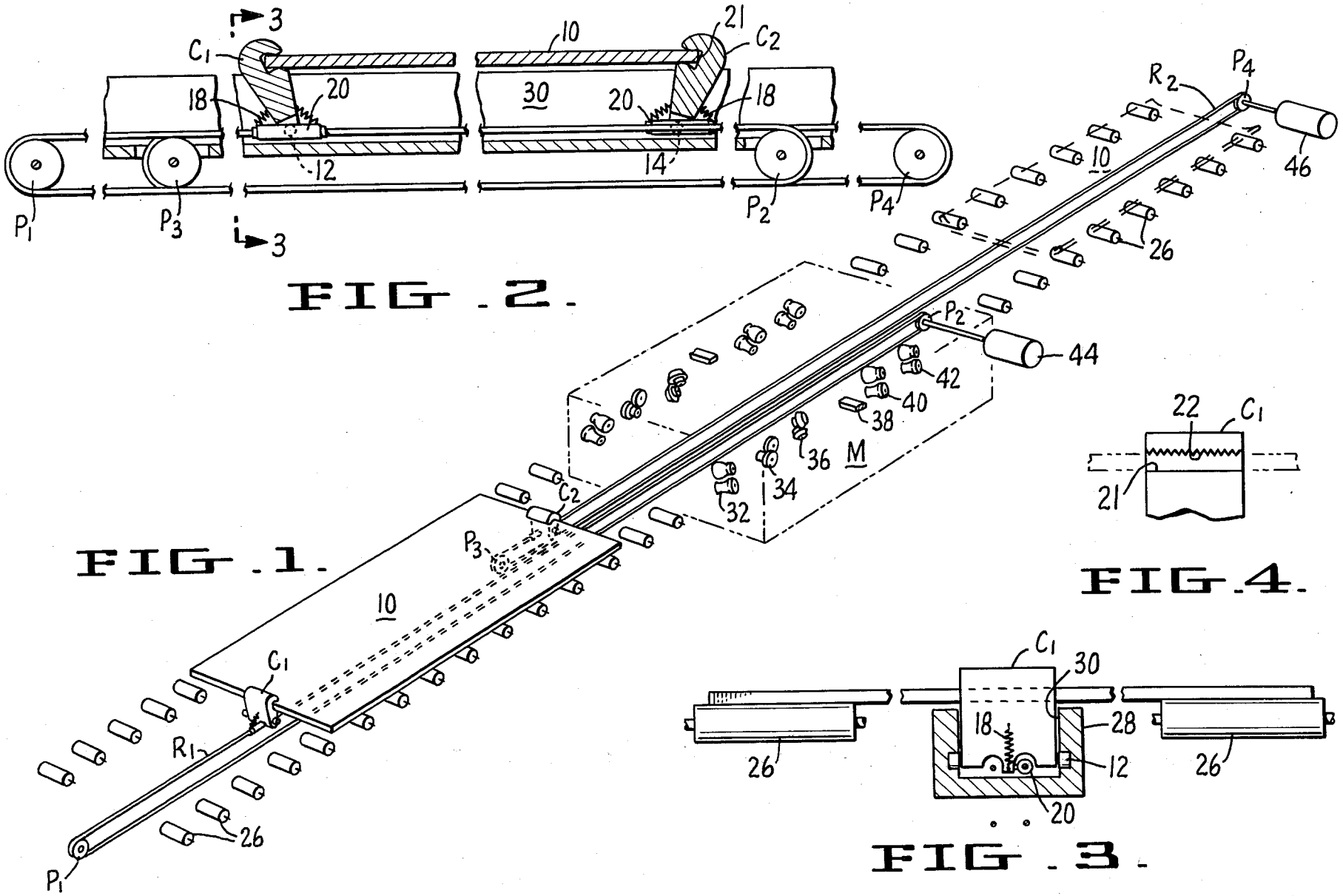
FIG. 1 is a diagrammatic view in perspective of the latch and guide system in a typical application within the scope of the invention.
FIG. 2 is a longitudinal view partly in section and broken away in places showing the clamps, pulleys and cable means of one useful embodiment of the invention while the plate is engaged by the clamps and held in place for working.
FIG. 3 is a view, partly in section, along line 3—3 of FIG. 2 looking in the direction of the arrows.
FIG. 4 is a fragmentary view of the top portion of a clamp of the invention and looking in a direction opposite to that of FIG. 3.
Figure 5:
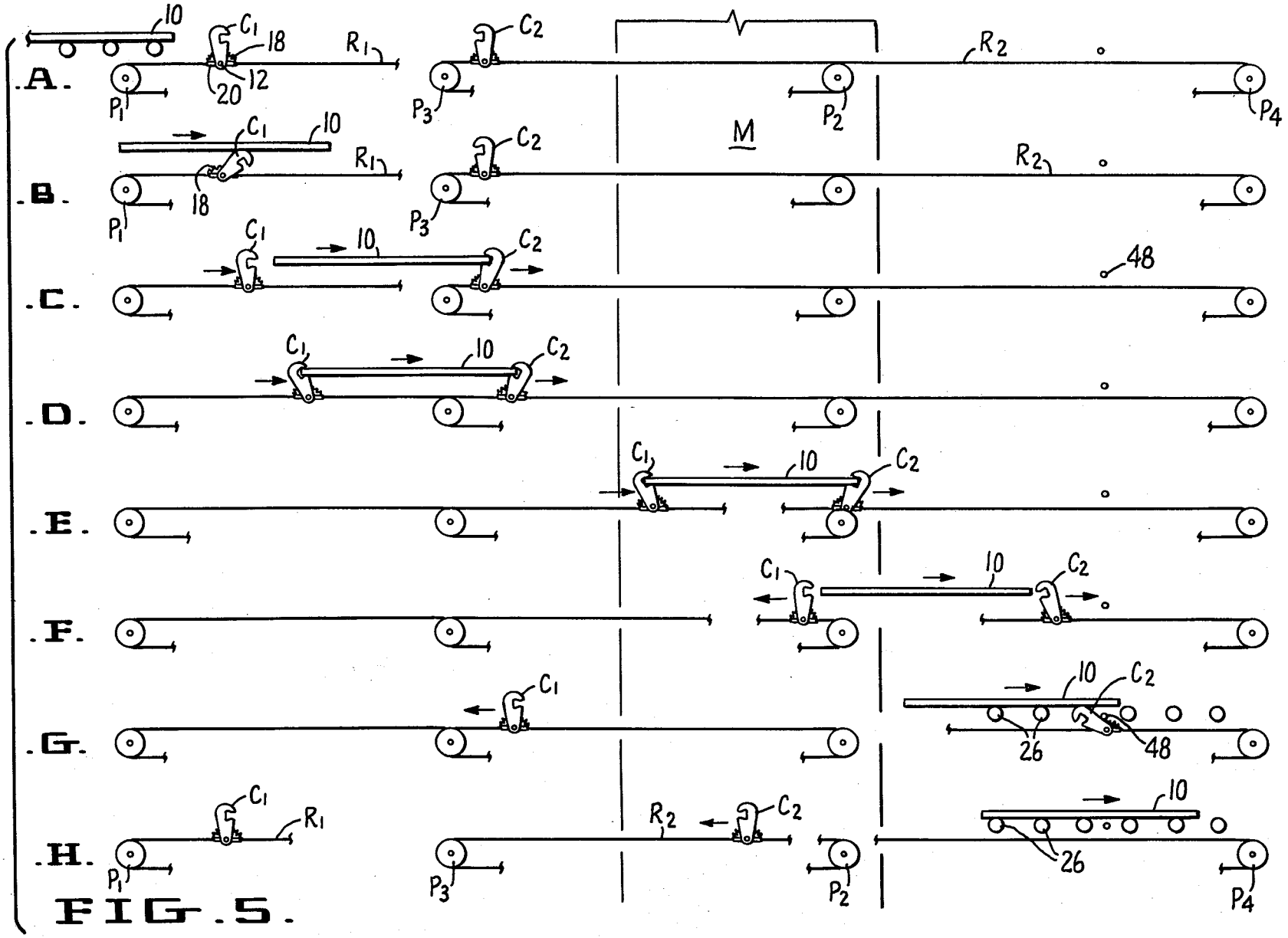
FIGS. 5A through 5H show various operating positions of the latch and guide system and apparatus of the invention during the sequence of steps employed in the operation.

The drawings show the working of a steel plate section 10 which is to be edge trimmed and subjected to various edge beveling, planing and roll forming operations. Such an operation subjects the plate to lateral forces which if not controlled results in skewing and misalignment of the plate. Machine M is a roll forming machine adapted to bend, trim, bevel and further bend the edges of plate 10 preparatory to passing the plate along a conventional runout table 24, having a plurality of spaced apart rolls 26, and on to a pipe forming operation (not shown).

Elements $C_1$ and $C_2$ are tail clamps and lead clamps, respectively, which are shaped in the manner shown in the drawings (see FIGS. 2, 3, 4, and 8) so that the mouth portions thereof are adpated to engage the trailing and leading edges of plate 10.

Clamp $C_1$ is hinged at 12 so that it may pivot at that point as required during the various stages of operation of the invention. Clamp $C_2$ is hinged at 14 in the same manner for the same purpose.

Cable or chain means are provided to move clamps $C_1$ and $C_2$ as required for the various operations within the system. Clamp $C_1$ is attached to cable or chain $R_1$ or any other suitable wire rope or the like which can traverse the pulley assembly hereafter described and apply the forces required to cause sufficient gripping pressure on the plate 10 as it travels along its path. A similar cable or chain arrangement $R_2$ is provided to actuate clamp $C_2$ and move it along its path of travel.

The hinge or pivot arrangement for clamps $C_1$ and $C_2$ at points 12 and 14, respectively, each include a base bar 20 affixed to each of the cables $R_1$ and $R_2$ as well as to the clamp which is suppprts. Tension springs 18 are fastened at one of their ends to the opposite ends of base bar 20 and extend to the nearest face of the clamp supported on the particular bar with which it cooperates. Springs 18 are designed to maintain the clamps in an erect position when the clamps are not engaged and also to yield or depress when a plate contacts the clamp near its top at other than its open mouth or when the clamp contacts a stop element. Other means of holding the clamp erect may be used to accomplish the required functions such as compression springs, detents or the like.

The face of each clamp adapted to engage plate 10 has an open mouth or jaw section 21 adapted to receive plate 10 or the like to effect engagement bewteen the two elements. Advantageously, teeth 22 may be used in the clamps to insure a tighter grip on plate 10 at the area of engagement.

The clamps designated C and described herein, including the jaw-like mouth 21, upper teeth 22 and the hinge or pivot point 12 or 14, are important features of the invention. As is disclosed in FIG. 8, the jaws advantageously have upper and lower inserts 16 and 17 respectively, of tool steel which can be changed as required to accommodate wear or the requirements of a particular product.

One advantage of the design of clamp C is that it can firmly grasp the edge of a plate while a relatively low force is applied to provide tension to the cable means which actuates the clamp to cause it to move along its path of travel. As will be noted in FIG. 8, $F_2$ and $F_3$ are the respective forces applied by the upper and lower jaws 16 and 17 of a clamp when in engagement with the edge of a plate. $1_1$ is the lever arm extending the distance from a pivot point on base bar 10 attached to the cable to the plate side which lower jaw 17 is in contact. $1_2$ represents the distance between the point on the edge of plate 10 at which the force $F_2$ is applied to the plate by upper jaw 16 and the force $F_3$ is applied by lower jaw 17. Thus, the greater the ratio of the length of $1_1$ relative to the length of $1_2$, the lesser is the force $F_1$ which is the force applied to the force $F_1$ required to actuate the cables, or conversely the greater are the forces $F_2$ and $F_3$ and the gripping engagement of the plate.

Clamps C are normally relatively large castings of iron or steel and when gripping a plate edge during normal operation can be very effective to prevent misalignment.

Clamps $C_1$ and $C_2$ are arranged within channel 28 which extends the length of the guide system. The inside vertical or side faces 30 of channel 28 act as side guides for clamps $C_1$ and $C_2$ along their length of travel within the system. Runout table 24 and the series of rolls 26 provide support for plate 10 during its passage through the system.

A series of pulleys, $P_1$ and $P_2$, are provided as tail and head pulleys, respectively, and define the path of travel of cable $R_1$ to which tail clamp $C_1$ is attached. In like manner a pair of pulleys, $P_3$ and $P_4$, are provided as tails and head pulleys, respectively, to define the path of travel of cable $R_2$ to which lead clamp $C_2$ is attached.

In the embodiment shown, forming rolls 32, 40 and 42 of machine M are provided to crimp and preform the edges of plate 10. In such an arrangement for example, roll 32 imparts the initial desired roll forming radius to the edges while rolls 40 and 42 insure conformity of the plate edges to the desired contour.

Cutters and bevelers 34, 36 and 38 trim, bevel and otherwise shape the edges of plate 10 to the width and edge contour required for the welding operation wherein the edges are joined to form the pipe section after the plate section is bent to a U-shape, and then to an O-shape prior to final welding into a finished pipe.

It can be appreciated from the foregoing type of edge treatment that the metal plate is subjected to a variety of lateral forces and that it is necessary to provide an efficient and reliable latch and guide system for directing plate 10 through the system without misalignment or skewing.

As heretofore stated, the work that can be performed on the plate may take many forms. Although the arrangement shown in M hereof is a machine for preforming and edge trimming plates prior to forming heavy gauge pipe for use in high pressure steel pipe lines, many other operations requiring latch and guide systems to prevent misalignment and skewing of a metal section as it is conveyed to, through and away from a forming operation may be employed.

In the embodiment of the invention disclosed in the series of drawings of FIGS. 5A through 5H steel plate 10 is shown in various positions wherein the clamping system of the invention is utilized during working.

FIG. 5A shows clamp $C_1$ and $C_2$ in a stationary and starting upright position ready to receive advancing plate 10 moving forward on conveyor table 24.

As plate 10 is moved forward by separate conveying means its leading edge contacts clamp $C_1$ while in a stationary position at its top to depress it so that $C_1$ pivots at 12 thereby extending the rearmost tension spring 18 and permitting the cooperating forward spring to compress, as shown in FIG. 5B. As plate 10 continues at uniform speed it also engages clamp $C_2$ and forces the clamp to move with it toward machine M while maintaining sufficient cable tenison to insure adequate gripping. Cable $R_2$ is moving at the same speed as the plate and with sufficient tension to enable clamp $C_2$ to maintain a firm grip on the leading edge of plate 10.

At the time of engagement of lead clamp $C_2$ with the lead end of plate 10, the (See FIG. 5C) tail clamp $C_1$ is no longer depressed by plate 10 and spring 18 returns it to an erect position. Cable $R_1$ then moves forward at a greater speed than that of the plate so that tail clamp $C_1$ advances and engages the trailing edge of plate 10 as shown in FIG. 5D. Tension is then applied to both cables $R_1$ and $R_2$, so that they provide tension on the clamps, $C_1$ and $C_2$ while moving at the speed of the plate toward machine M and thus maintaining the required clamping pressure.

Plate 10 when fastened in this manner continues to travel at constant speed through the machine while clamps $C_1$ and $C_2$ restrain lateral motion as the plate is worked in the machine. Meanwhile, the clamps are also restrained from lateral movement by the side guides 28 and 30 which extend along the length of the latch and guide system. FIG. 5E shows plate 10 while it is being worked in machine M.

After work has been completed on the side edges of the plate in the machine and the leading edges of the plate have passed from the machine, tension is applied in the reverse direction to both cables $R_1$ and $R_2$ to enable clamps $C_1$ and $C_2$ to disengage from the plate. Both clamps are shown in the disengaged position in FIG. 5F.

FIG. 5G shows clamp $C_1$ in the course of its travel back to its original position shown in FIG. 5A. Clamp $C_2$, which has been drawn away from the leading edge of plate 10 at a speed greater than that of plate 10, proceeds forward until it contacts stop 48 which depresses $C_2$ below the bottom of the plate to permit plate 10 to ride over it. Plate 10 proceeds forward as shown in FIG. 5G while clamp $C_2$ is in a lowered position and the plate rides freely over it.

Clamp $C_1$ which is returned by reversing the direction of cable $R_1$ while the speed of cable $R_1$ is increased. $R_1$ is thus returned to its original position and remains stationary to await the next plate. Cable $R_2$ also reverses direction and returns clamp $C_2$ to its starting position at an increased speed, all as shown in FIG. 5H. When both clamps $C_1$ and $C_2$ have returned to their starting positions they are ready to receive the next plate for its travel through the system as heretofore described.

Motors 44 and 46 as shown in FIG. 1, or other suitable driving equipment, are provided to actuate the respective pulley system in the manner described and independent of the plate conveying means.

The alternative embodiment of the invention shown in FIGS. 6A, 6B, 6C and FIG. 7 utilizes a clamp and pulley system wherein the clamps and cables are designed to travel forward about the pulleys after the work has been completed on a plate rather than returning the clamps by reversing the direction of the cables. This alternate arrangement differs from that heretofore described and as shown in FIGS. 1 through 5 in that there are separate channels for each clamp and cable and in that there are two clamps on each cable. In other respects the latch and guide system is constructed and operates in substantially the same manner as that heretofore described.

More specifically, clamps $C_5$ and $C_7$ which are adapted to engage the trailing edge of plate 10' are mounted on the cable or chain strand $R_3$ at points equidistant from each other. Also, clamps $C_6$ and $C_8$ which are intended to engage the leading edge of plate 10' are likewise mounted on cable $R_4$. Cable $R_3$ travels about pulleys $A_1$ and $A_2$ while cable $R_4$ travels about pulleys $B_1$ and $B_2$. Any suitable system can be used for mounting the clamps on the cables or chains about which they are pivoted. The mounting means disclosed in FIG. 2 can be used advantageously in the system in FIGS. 6A, 6B and 6C.

Figures 6A, 6B, 6C, 7, 8:
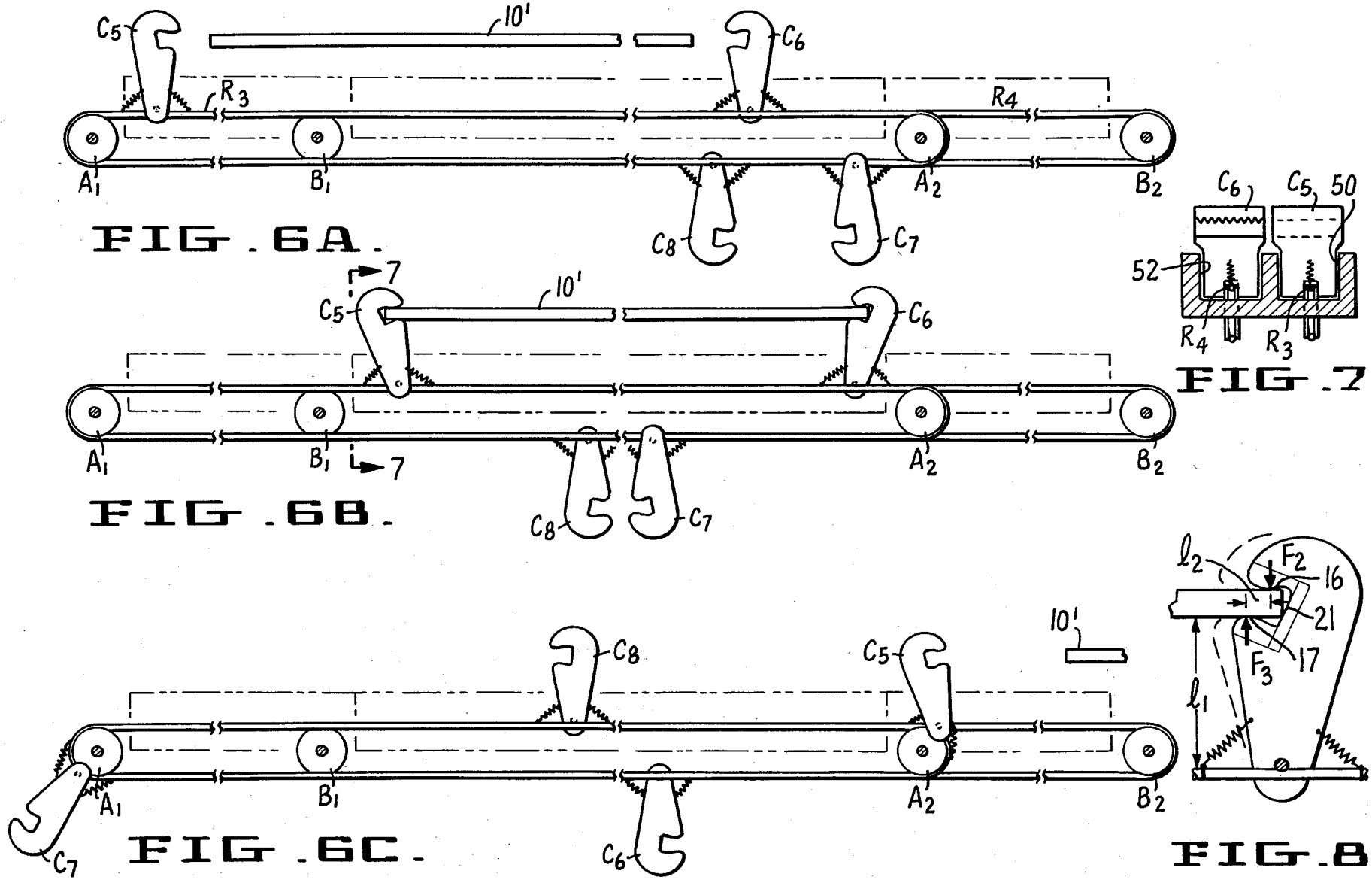
FIGS. 6A, 6B and 6C are diagrammatic longitudinal views of an advantageous alternative arrangement of the clamp and pulley assembly of the invention.
FIG. 7 is a view partly in section along line 7—7 of FIG. 6B looking in the direction of the arrows.
FIG. 8 is a side view partly in section of a clamp of the type useful in the various embodiments of this invention and showing the forces exerted by the jaws of the clamp when engaging a plate.

FIG. 6A shows clamps $C_5$ and $C_6$ mounted for engagement at the trailing and leading edges, respectively, of plate 10'. By the system cable $R_3$ is moved at a speed greater than that of 10' so that it speeds up to engage the trailing edge thereof immediately after the leading edge contacts lead clamp $C_6$. The work then travels through the fabricating step as shown in FIG. 6B where the speed of movement of plate 10' and that of cables $R_3$ and $R_4$ are the same.

After the working step the plate assembly with the engaged clamps moves out of the machine and the speed of cable $R_4$ is increased over that of plate 10' and disengages from the plate. The speed of cable $R_3$ is decreased to permit the plate moving to proceed ahead free of clamps $C_5$ and $C_6$. Thereafter, cables $R_3$ and $R_4$ proceed at a uniform speed with all clamps spaced from the plate. Meanwhile, a new plate enters the system and clamps $C_7$ and $C_8$, which cooperate in the same manner as clamps $C_5$ and $C_6$, engage the trailng and leading edges of the new plate and proceed through the system as described.

FIG. 7 shows the arrangement of cables $R_3$ and $R_4$ within channels 50 and 52, respectively, wherein they are held in a side by side relationship with a common side wall. The side walls of the channels serve as side guides for the respective pairs of clamps that travel through the twin channels. As in the case of the embodiment of FIGS. 1 through 5 the channels of this alternative extend the length of the system between $B_1$ and $A_2$ and are a single channel for cable $R_3$ and $R_4$ from $A_1$ to $B_1$ and $A_2$ to $B_2$ respectively.

Although the operation of both of the embodiments of the invention described hereinabove contemplates that the speed of the cable carrying the tail clamp shall be slowed to enable the clamp to lag behind the moving plate until the leading edge therein engages the lead clamp, and after such contact the movement of the cable for the tail clamp is increased to a speed greater than the plate to effect locking engagement between the tail clamp and the trailing edge, the operation may be modified within the scope of the invention by adjusting cable speeds so that the tail clamp engages the plate edge before the lead clamp engagement is effected or the two clamps may engage the plate at approximately the same time.

I claim:

1. Apparatus for clamping and guiding a section of metal plate to restain lateral movement thereof as it travels longitudinally through a machine wherein said plate is subjected to mechanical work and to forces inducing lateral movement of the plate comprising, conveyor means for longitudinally moving the plates, first clamp means adapted to engage the trailing edge of said plate while moving on said conveyor means, second clamp means adapted to engage the leading edge of said plate while moving on said conveyor means, guide means for positioning said first and second clamps and extending along the length of said apparatus wherein said lateral forces are effective, first cable means to which said first clamp means are attached, second cable means to which second clamp means are attached, a first pulley system for actuating said first cable means whereby said first clamp means and said first cable means travel forward to engage the trailing edge of said plate travelling toward said machine on said conveyor means to thereby place said first cable means under tension and create a locking force sufficient to lock said first clamp means on said plate, a second pulley system for actuating said second cable means whereby said second clamp means travels forward after engagement with the leading edge of said plate travelling toward said machine on said conveyor means to thereby place said second cable means under tension and create a locking force sufficient to lock said second clamp means on said plate and enable said first and second cable means and clamp means to travel with said plate through said machine, said first pulley system and said second pulley system being located adjacent to the longitudinal centerline of said metal plate and in a plane parallel to and spaced from the path of travel of said metal plate to enable said first and second clamp means to engage said edges of said plate at points spaced from the longitudinal edges thereof to thereby leave said longitudinal edges unobstructed for the application of mechanical work thereto, and means for disengaging said clamp means from said plate edges after said plate has passed through said machine.

2. The apparatus of claim 1 wherein said guide means comprises a recessed channel beam having a pair of vertically disposed side walls adapted to serve as side guides for said first and second clamp means and to restrain lateral movement thereof as each of said clamp means travels along the length of said machine.

3. The apparatus of claim 1 wherein means are provided to reverse the direction of movement of said first and second cable means after said first and second clamp means have been disengaged from said plate edges to thereby return said clamp means to their original positions to receive a new plate to be subjected to work.

4. The apparatus of claim 1 wherein said guide means comprises a channel beam having a pair of recessed areas having vertically disposed side walls, one of said recessed areas being adapted to serve as side guide means for said first clamp means and the other of said recessed areas being adapted to serve as side guide means for said second clamp means, whereby both of said side guide means restrains lateral movement of both of said clamp means.

5. The apparatus of claim 1 wherein means are provided to permit continued forward movement of said first and second cable means after disengagement from said plate edges to thereby return said clamp means to their original positions to receive a new plate to be subjected to work.

6. The apparatus of claim 5 wherein said first and second clamp means each comprise a pair of clamps affixed to each of said first and second cooperating cable means at equidistant points on each of said cable means.

7. The apparatus of claim 1 wherein each of said clamp means is pivoted at a base affixed to one of said cable means and is maintained in operative position by a pair of separate spring means, one end of said spring means being attached to an end wall of said clamp means and the other end of said spring means being attached at the other end wall of said clamp means, and each of the other ends of said spring means being attached to opposite ends of said base.

8. The apparatus of claim 1 wherein each of said clamp means comprise an element having at one of its ends an opening in one end wall thereof and whereby it may receive a plate in gripping engagement therewith, and the opposite end of said clamp means being pivotally attached to cable means for actuating said clamp means.

9. Apparatus for clamping and guiding a section of metal plate to restrain lateral movement thereof as it travels longitudinally through a machine wherein said plate is subjected to mechanical work and to forces inducing lateral movement of the plate comprising, conveyor means for longitudinally moving the plates, first clamp means comprising a pair of clamps adapted to engage the trailing edge of said plate while moving on said conveyor means, second clamp means comprising a pair of clamps adapted to engage the leading edge of said plate while moving on said conveyor means, guide means for positioning said first and second clamps and extending along the length of said apparatus wherein said lateral forces are effective, first cable means to which said first clamp means are attached, second cable means to which second clamp means are attached, said first and second clamp means each being affixed to each of said first and second cooperating cable means at equidistant points on each of said cable means, a first pulley system for actuating said first cable means whereby said first clamp means and said first cable means travel forward to engage the trailing edge of said plate travelling toward said machine on said conveyor means to thereby place said first cable means under tension and create a locking force sufficient to lock said first clamp means on said plate, a second pulley system for actuating said second cable means whereby said second clamp means travels forward after engagement with the leading edge of said plate travelling toward said machine on said conveyor means to thereby place said second cable means under tension and create a locking force sufficient to lock said second clamp means on said plate and enable said first and second cable means and clamp means to travel with said plate through said machine, and means to permit continued forward movement of said first and second cable means for disengagement from said plate edges to thereby return said first and second clamp means to their original positions to receive a new plate to be subjected to work.

10. The apparatus of claim 9 wherein said guide means comprises a recessed channel beam having a pair of vertically disposed side walls adapted to serve as side guides for said first and second clamp means and to restrain lateral movement thereof as each of said clamp means travels along the length of said machine.

11. The apparatus of claim 9 wherein each of said clamp means is pivoted at a base affixed to one of said cable means and is maintained in operative position by a pair of separate spring means, one end of said spring means being attached to an end wall of said clamp means and the other end of said spring means being attached at the other end wall of said clamp means, and each of the other ends of said spring means being attached to opposite ends of said base.

* * * * *